US008316931B2

(12) United States Patent
Rondeau et al.

(10) Patent No.: US 8,316,931 B2
(45) Date of Patent: Nov. 27, 2012

(54) EQUIPMENT FOR REMOTE LAUNCHING OF CEMENTING PLUGS

(75) Inventors: Joel Rondeau, Antony (FR); André Salvaire, Montigny le Bretonneux (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 231 days.

(21) Appl. No.: 12/870,344

(22) Filed: Aug. 27, 2010

(65) Prior Publication Data

US 2011/0067866 A1 Mar. 24, 2011

(30) Foreign Application Priority Data

Sep. 3, 2009 (EP) ..... 09290672

(51) Int. Cl.
*E21B 33/16* (2006.01)

(52) U.S. Cl. ..... 166/119; 166/153

(58) Field of Classification Search ..... 166/285, 166/291, 292, 119, 192, 202, 70, 153, 155, 166/156

See application file for complete search history.

(56) References Cited

U.S. PATENT DOCUMENTS

| | | | | |
|---|---|---|---|---|
| 3,616,850 | A | 11/1971 | Scott | |
| 3,863,716 | A | 2/1975 | Streich | |
| 4,042,014 | A | 8/1977 | Scott | |
| 4,574,882 | A | 3/1986 | Szarka | |
| 4,674,573 | A * | 6/1987 | Bode | 166/291 |
| 5,004,048 | A | 4/1991 | Bode | |
| 5,095,988 | A | 3/1992 | Bode | |
| 5,435,390 | A | 7/1995 | Baugh et al. | |
| 5,553,667 | A | 9/1996 | Budde et al. | |
| 5,590,713 | A | 1/1997 | Baugh et al. | |
| 5,787,979 | A | 8/1998 | Giroux et al. | |
| 5,813,457 | A | 9/1998 | Giroux et al. | |
| 5,833,002 | A | 11/1998 | Holcombe | |
| 5,890,537 | A | 4/1999 | Lavaure et al. | |
| 5,950,724 | A | 9/1999 | Giebeler | |
| 6,056,053 | A | 5/2000 | Giroux et al. | |
| 6,799,638 | B2 | 10/2004 | Butterfield, Jr. | |
| 6,802,372 | B2 | 10/2004 | Budde | |
| 7,143,831 | B2 | 12/2006 | Budde | |
| 7,866,390 | B2 * | 1/2011 | Latiolais et al. | 166/285 |
| 2003/0141052 | A1 * | 7/2003 | Pedersen et al. | 166/70 |
| 2003/0164237 | A1 | 9/2003 | Butterfield, Jr. | |
| 2004/0231836 | A1 | 11/2004 | Budde | |

(Continued)

FOREIGN PATENT DOCUMENTS

| | | |
|---|---|---|
| EP | 0500165 | 8/1992 |

(Continued)

OTHER PUBLICATIONS

Leugemors E, Metson J, Pessin J-L, Colvard RL, Krauss CD and Plante M: "Cementing Equipment and Casing Hardware," in Nelson EB and Guillot D (eds.): Well Cementing—2nd Edition, Houston: Schlumberger (2006): 343-434.

(Continued)

*Primary Examiner* — Daniel P Stephenson
(74) *Attorney, Agent, or Firm* — Matthias Abrell

(57) ABSTRACT

Equipment for servicing subterranean wells, and in some cases, an apparatus and method for remotely launching cementing plugs during the primary cementation of a subterranean well. The top plug and bottom plug are launched by different mechanisms, thereby preventing premature release of the top plug during a cementing operation.

17 Claims, 4 Drawing Sheets

U.S. PATENT DOCUMENTS

| | | | | |
|---|---|---|---|---|
| 2006/0027122 | A1 | 2/2006 | Arce et al. | |
| 2011/0146986 | A1* | 6/2011 | Giem et al. | 166/291 |
| 2011/0240316 | A1* | 10/2011 | Rondeau | 166/386 |
| 2011/0290481 | A1* | 12/2011 | Rondeau et al. | 166/265 |
| 2012/0031614 | A1* | 2/2012 | Rondeau et al. | 166/293 |
| 2012/0090835 | A1* | 4/2012 | Kefi | 166/252.6 |

FOREIGN PATENT DOCUMENTS

| | | |
|---|---|---|
| EP | 0450676 | 6/1995 |
| EP | 1496193 | 1/2005 |
| EP | 1340882 | 10/2005 |
| WO | 94/28282 | 12/1994 |
| WO | 98/25004 | 6/1998 |
| WO | 99/24692 | 5/1999 |
| WO | 2006/014939 | 2/2006 |

OTHER PUBLICATIONS

Piot B and Cuvillier G: "Primary Cementing," in Nelson EB and Guillot D (eds.): Well Cementing—2nd Edition, Houston: Schlumberger (2006): 459-501.

Brandt W et al.: "Deepening the Search for Offshore Hydrocarbons." Oilfield Review (Spring 1998) 10, No. 1, 2-21.

* cited by examiner

EQUIPMENT FOR REMOTE LAUNCHING OF CEMENTING PLUGS

BACKGROUND OF THE INVENTION

The statements in this section merely provide background information related to the disclosure and may not constitute prior art.

Some embodiments are related to equipment for servicing subterranean wells. Particularly, in some cases, to an apparatus and a method for remotely launching cementing plugs during the primary cementation of a subterranean well.

Most primary cementing treatments involve the use of wiper plugs that travel through the interior of a tubular body (e.g., casing or liner). When launched, the plugs travel from the top of the tubular body to the bottom, where they become seated. The purpose of the plugs is to separate and prevent commingling of different fluids during their journey through the tubular body. In most cases, operators deploy a bottom plug and a top plug.

After the tubular body is installed in the wellbore, the annulus between the tubular body and the wellbore wall (or another tubular body) is usually filled with drilling fluid. When the primary cementing treatment commences, the bottom plug is first launched into the tubular body, followed by the cement slurry. The cement slurry may be preceded by a spacer fluid, a chemical wash or both. The function of the bottom plug is mainly to scrape traces of drilling fluid from the internal surface of the tubular body, and to prevent contact between the drilling fluid and the cement slurry.

The bottom-plug launching and conveyance through the tubular body arises from pressure applied by the cement slurry. When the bottom plug completes its journey through the tubular body, it becomes seated on float equipment installed at the bottom of the tubular body. Continued pumping exerts sufficient pressure to rupture a membrane at the top of the bottom plug, allowing the cement slurry to flow through an interior passage in the bottom plug, and then to exit the bottom of the tubular body and in order to continue into the annulus.

After sufficient cement slurry, to fill the annulus, has been pumped into the tubular body, the top plug is launched into the tubular body, and a displacement fluid is pumped behind the plug. The displacement fluid forces the plug through the tubular body. The function of the top plug is mainly to scrape traces of cement slurry from the internal surface of the tubular body, isolate the cement slurry from the displacement fluid and, upon landing on the bottom plug, seal the interior tubular body from the annulus. Unlike the bottom plug, the top plug has no membrane or interior passage through which fluids may flow.

A thorough description of the primary cementing process and the equipment employed to perform the service may be found in the following references. (1) Piot B. and Cuvillier G.: "Primary Cementing," in Nelson E. B. and Guillot D. (eds.): *Well Cementing*-2$^{nd}$ Edition, Houston: Schlumberger (2006): 459-501. (2) Leugemors E., Metson J., Pessin J.-L., Colvard R. L., Krauss C. D. and Plante M.: "Cementing Equipment and Casing Hardware," in Nelson E. B. and Guillot D. (eds.): *Well Cementing*-2$^{nd}$ Edition, Houston: Schlumberger (2006): 343-434.

Wiper plugs are usually launched from a cementing head that is attached to the tubular body near the drilling rig. The tubular body rises from the bottom of the openhole to the rig floor. However, for subsea completions, the problem becomes more complicated, and fluid isolation becomes more and more critical as water depth increases. It thus becomes impractical to launch wiper plugs from the surface. Therefore, the cementing head containing the wiper plugs rests on the seafloor, and the top of the tubular body ends at the mudline. Drillpipe connects the top of the tubular body to the rig floor on the surface. During the cementing process, darts are released into the drillpipe on surface, travel through the drillpipe to the seafloor and, upon arrival, trigger the release of the wiper plugs.

After the first dart is launched, cement slurry is pumped behind it. When the first dart lands inside the cementing head, the bottom plug is released. The second dart is launched after sufficient cement slurry has been pumped to fill the annulus. A displacement fluid is pumped behind the second dart. When the second dart arrives, the top plug is released. A brief peak in surface pressure indicates when each wiper plug has been launched. This process is detailed in the following references: (1) Buisine P. and Lavaure G.: "Equipment for Remote Launching of Cementing Plugs into Subsea Drilled Wells," European Patent Application 0 450 676 A1 (1991); (2) Brandt W. et al.: "Deepening the Search for Offshore Hydrocarbons." *Oilfield Review* (Spring 1998) 10, No. 1,2-21.

Those skilled in the art will understand that process fluids may comprise drilling fluids, chemical washes, spacer fluids and completion fluids.

A disadvantage of the subsea plug launching mechanism currently used in the art is that each dart is identical; therefore, after launching, the plug-release process is passive. The plug-releasing mechanism is the same for both the bottom and top plugs. If for any reason the bottom dart does not stop traveling downward after the bottom plug is launched, the potential exists for the top plug to be launched prematurely. Such an occurrence could result in cement slurry being left inside the tubular body—a condition known as "cement left in pipe" or CLIP.

Therefore, it remains desirable to provide an improved apparatus and methods that would prevent premature release of the top plug resulting from improper function of the bottom dart.

SUMMARY

Some embodiments serve to address the problems mentioned herein.

The first aspect is an apparatus by which the bottom and top cementing plugs are released by different mechanisms. First, the bottom-dart of the invention 11 (FIG. 1) has an internal movable rod 12 that initially extends from the top, but can be pushed down so that it extends from the bottom. Second, as shown in FIG. 1, the main rod 5 contains a movable internal rod 13 that is surrounded by a movable sleeve 14. The internal rod 13 initially extends from the main rod 5 into the sleeve 14, but can be pushed downward so that it extends from the bottom of the rod. Then, also shown in FIG. 1, is another movable sleeve 17 that is held in place by a shear pin 18. After that, as shown in FIG. 2, the bottom end of the main rod 5 just above the piston 4 is surrounded by a sleeve 15 that contains ball bearings 16. The sleeve and ball bearings initially attach the main rod 5 securely to the piston 4.

The inventive design as described herein allows the release of the top plug only when a specific chain of events occurs. In fact, the top dart 9 needs to land on the bottom dart 11, in order to force the internal movable rod 12 downward so that it extends out of the posterior of the bottom dart (FIG. 3, Step C). When the internal movable rod 12 extends out of the posterior of the bottom dart 11, the following events occur. First, the moveable rod 12 enters the interior of movable sleeve 14, which is in contact with movable sleeve 17, forcing shear pin 18 to break (FIG. 3, Step D). Second, the internal movable rod 12 also forces internal movable rod 13 inside main rod 5 downward so that it extends from the bottom of the main rod. Third, movement of the internal movable rod 13 into the sleeve 15 actuates a release mechanism 16 that comprises two ball bearings. The ball bearings move inward, freeing the main rod 5 from the piston 4, and allowing the main rod to extend below the piston. Although the design features ball bearings as a release mechanism, it will be appreciated by those skilled in the art that other release mechanisms such as shear pins, latches and the like may be employed in a similar manner. Downward movement of the main rod 5 causes the top plug 2 to be ejected from the plug basket 3 (FIG. 3, Step E).

The second aspect is a method for launching cementing plugs during a primary cementing operation. The method is shown in FIG. 3.

The apparatus described in the first aspect (except bottom dart 11 and top dart 9) is installed inside a casing string 20. A first process fluid is pumped from the surface through tubular body 19. The bottom dart 11 is launched into the process-fluid stream in the tubular body 19. A desired volume of a second process fluid is pumped behind the bottom dart 11. After a desired volume of the second process fluid has been pumped into the well, the top dart 9 is launched into the process fluid stream in the tubular body 19, followed by a third process fluid. Bottom dart 11 lands on movable sleeve 14, which is connected to the main rod 5 (FIG. 3, Step A). Continued process-fluid pumping forces movable sleeve 14, main rod 5 and the piston 4 downward, resulting in the ejection of the bottom plug 1 from the plug basket (FIG. 3, Step B). The movable sleeve 14 now rests on movable sleeve 17. The bottom plug 1 acts as a barrier between the first and second process fluids, preventing their commingling while traveling through the interior of the casing 20. When top dart 9 lands on bottom dart 11 (FIG. 3, Step C), the chain of events described earlier takes place, resulting in the ejection of the top plug 2 from the plug basket 3 (FIG. 3, Steps D and E). The top plug 2 acts as a barrier between the second and third process fluids, preventing their commingling while traveling through the interior of the casing 20. When the top plug 2 lands on the bottom plug 1, the region in the wellbore surrounding the casing 20 is filled with second process fluid, and the interior of the casing is filled with third process fluid.

The third aspect is a method for cementing a subterranean well.

The apparatus described by the first aspect (except bottom dart 11) is installed inside a casing string 20. A drilling fluid is pumped from the surface through tubular body 19. A bottom dart 11 is launched into the process fluid stream in the tubular body 19. A desired volume of a cement slurry is pumped behind the bottom dart 11. The cement slurry may preceded by a spacer fluid, a chemical wash or both. After a desired volume of cement slurry has been pumped into the well, a top dart 9 is launched into the process fluid stream in the tubular body 19, followed by a displacement fluid Bottom dart 11 lands on movable sleeve 14, which is connected to the main rod 5. Continued process-fluid pumping forces movable sleeve 14, main rod 5 and the piston 4 downward, resulting in the ejection of the bottom plug 1 from the plug basket. The movable sleeve 14 now rests on movable sleeve 17. The bottom plug 1 acts as a barrier between the drilling fluid and the cement slurry, preventing their commingling while traveling through the interior of the casing 20. When top dart 9 lands on bottom dart 11, the chain of events described earlier takes place, resulting in the ejection of the top plug 2 from the plug basket 3. The top plug 2 acts as a barrier between the cement slurry and the displacement fluid, preventing their commingling while traveling through the interior of the casing 20. When the top plug 2 lands on the bottom plug 1, the region in the wellbore surrounding the casing 20 is filled with cement slurry, and the interior of the casing is filled with displacement fluid.

All aspects may be applied in oil and gas wells, geothermal wells, water wells, and wells for chemical waste disposal, enhanced recovery of hydrocarbons and carbon sequestration.

DETAILED DESCRIPTION

Figure 1:
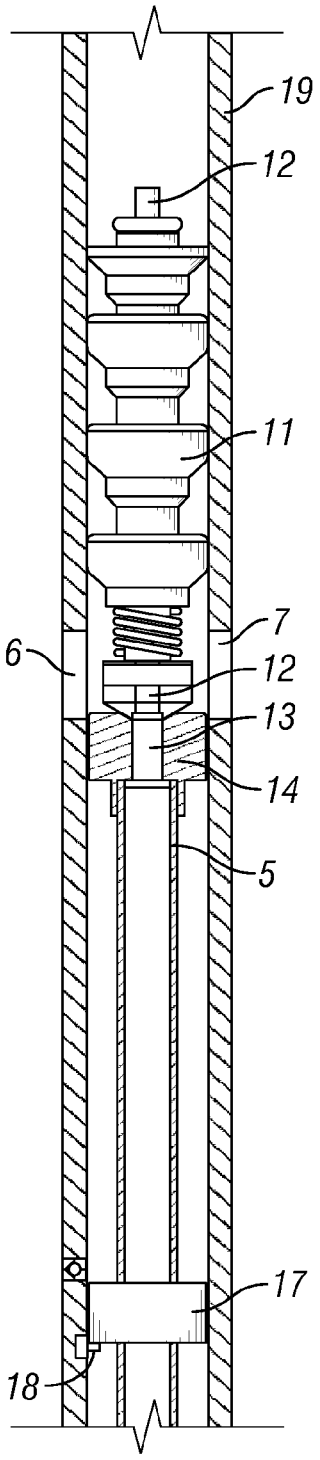
FIG. 1 shows the upper portion of the apparatus of an embodiment.
Figure 2:
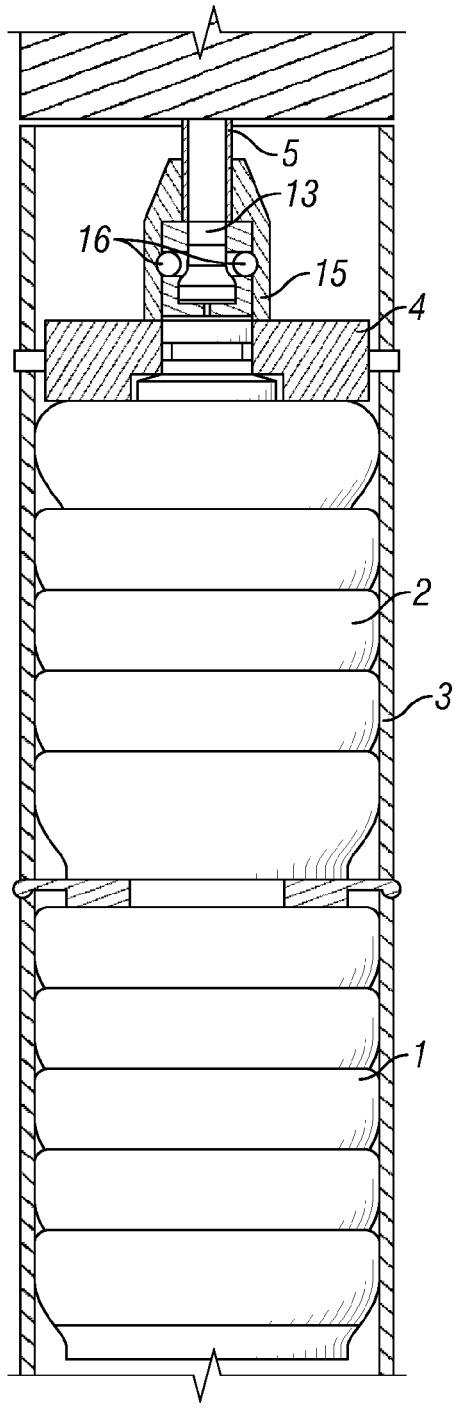
FIG. 2 shows the lower portion of the apparatus of an embodiment.
Figure 3A:
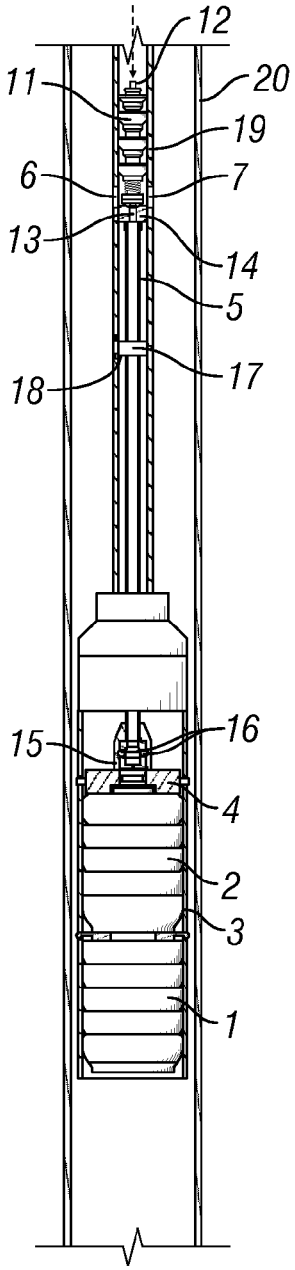
FIG. 3 illustrates the method by which the apparatus of an embodiment functions to release cementing plugs.
Figure 3B:
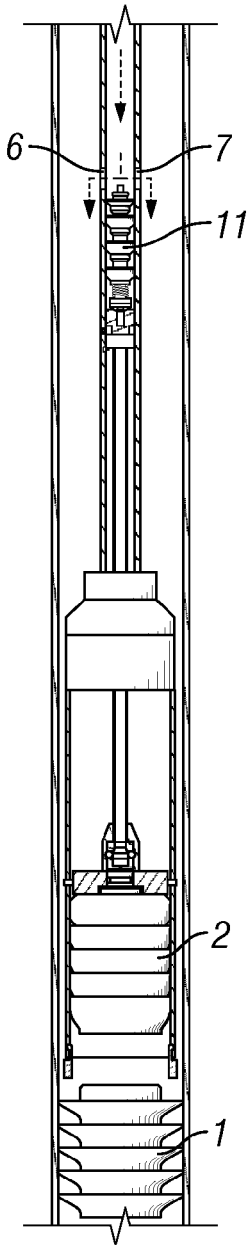
Figure 3C:
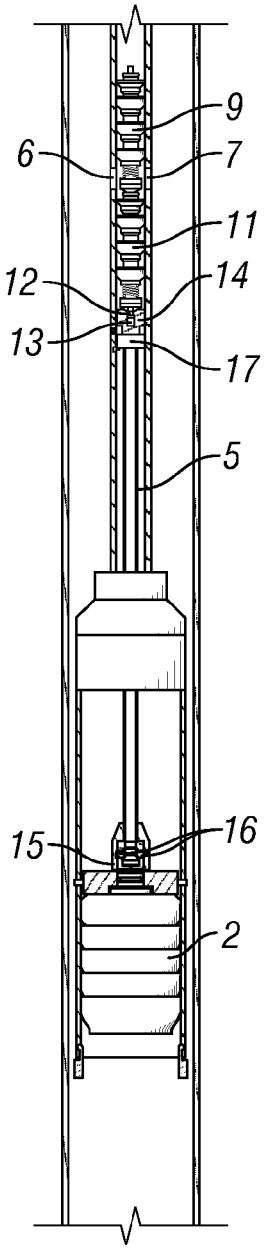
Figure 3D:
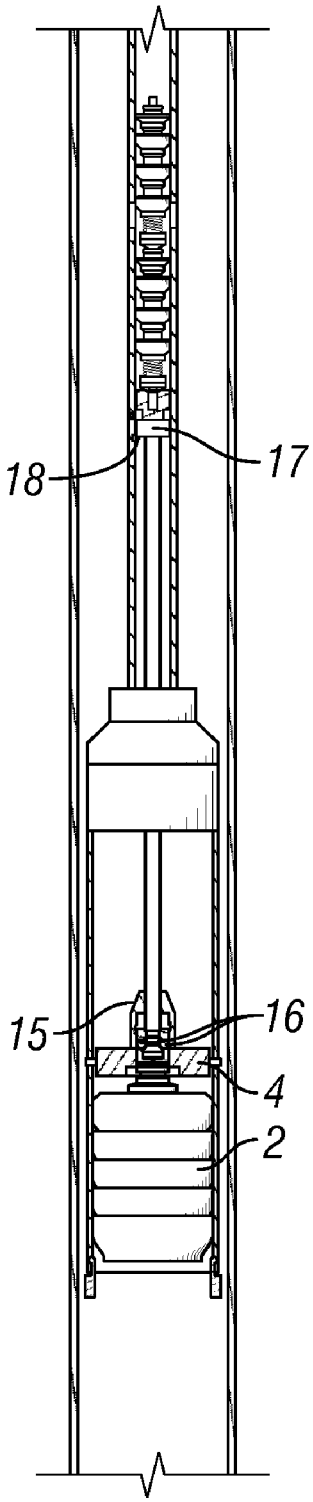
Figure 3E:
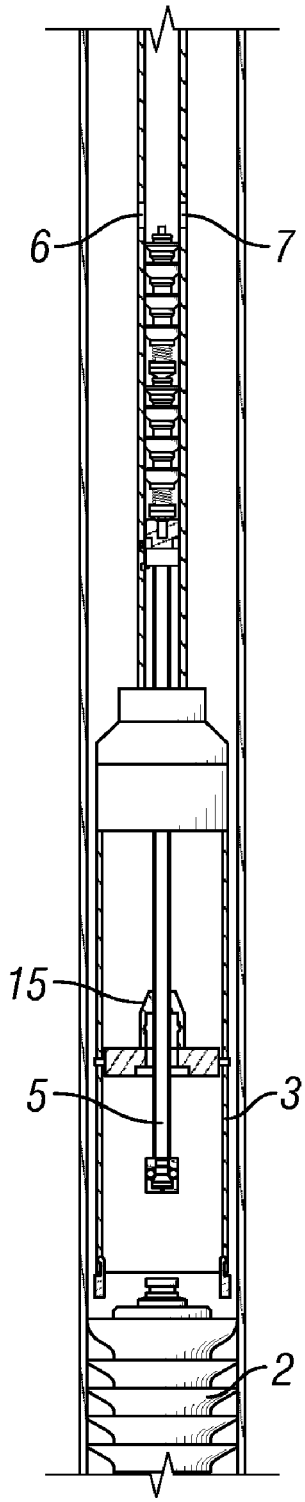

When cementing the annular space between tubulars and the walls of a subterranean wellbore, it is usually necessary to minimize or prevent the commingling of the drilling fluid, spacer fluid and cement slurry. Commingling may result, for example, in adverse rheological effects, dilution of the cement slurry and compromised zonal isolation. One way to minimize commingling involves using wiper plugs to separate fluids as they travel down the tubulars. Wiper plugs also clean the inner surface of the tubulars. Most cementing operations involve two wiper plugs: a bottom plug that separates cement slurry from drilling fluid, and a bottom plug that separates cement slurry from displacement fluid. The bottom plug travels through the tubular body (e.g., casing) and lands on float equipment at the bottom end. Continued pumping breaks a membrane in the bottom plug, allowing cement slurry to pass through the plug and enter the annular region around the tubular body. The top plug lands on top of the bottom plug, forcing the cement slurry out of the tubular-body interior, and leaving the tubular-body interior full of displacement fluid. Premature release of the top plug can result in the failure to pump all of the cement slurry out of the tubular body, and incomplete filling of the annular region around the outside of the tubular body. The present invention provides means and methods by which premature release of the top plug may be prevented.

The first aspect is an apparatus by which the bottom and top cementing plugs are released by different mechanisms. The apparatus is shown in FIGS. 1-5. The apparatus comprises three portions. The first portion comprises the following elements. A bottom plug 1 and a top plug 2 are located inside a plug basket 3. A piston 4, located above the plug basket 3, is driven by a main rod 5. Inside main rod 5 is a movable rod 13. There are three devices that surround the main rod 5: (i.) a sleeve 15 in which a release mechanism 16 is set such that the main rod 5 is initially fixed to the piston 4; (ii) a movable sleeve 17 inside a tubular body 19, positioned above sleeve 15, under which a shear pin 18 fixed to the tubular body 19 prevents downward movement; and (iii) another moveable sleeve 14 mounted at the top of the main rod 5, into which the movable rod 13 protrudes. The release mechanism 16 shown in the figures comprises two ball bearings; however, those skilled in the art will appreciate that other release mechanisms such as shear pins, latches and the like may also be suitable. Above the movable sleeve 14, there are ports 6 and 7 in the tubular body 19, through which wellbore-service fluids may flow. This first portion of the apparatus is initially installed inside another tubular body 20. The second portion of the apparatus is a bottom dart 11 (FIG. 1), with an interior movable rod 12 that initially protrudes from the top of the dart. This second portion of the apparatus is initially separated from the first portion. The third portion of the apparatus is a top dart 9 that is also initially separated from the first portion.

A second aspect is a method for launching cementing plugs during a primary cementing operation. The method is particularly shown in FIG. 3.

Figure 4:
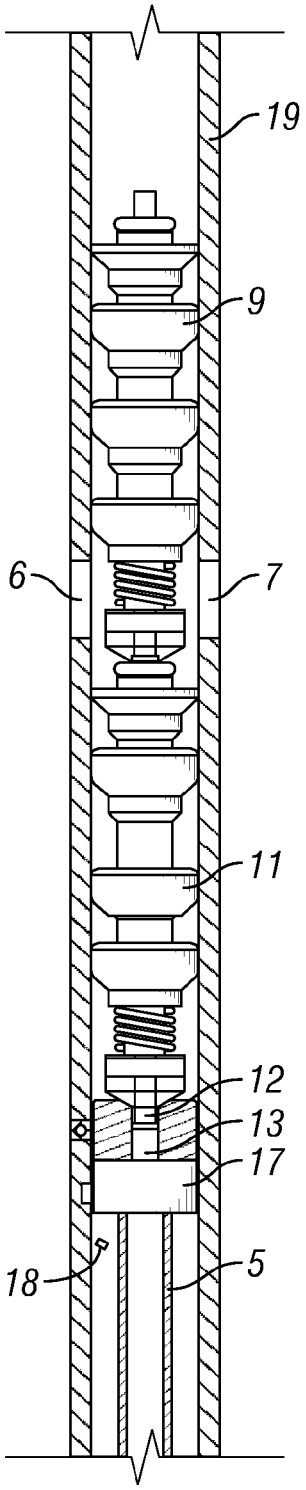
FIG. 4 is a detailed view of the upper portion of the apparatus of an embodiment, just prior to the launch of the top cementing plug.
Figure 5:
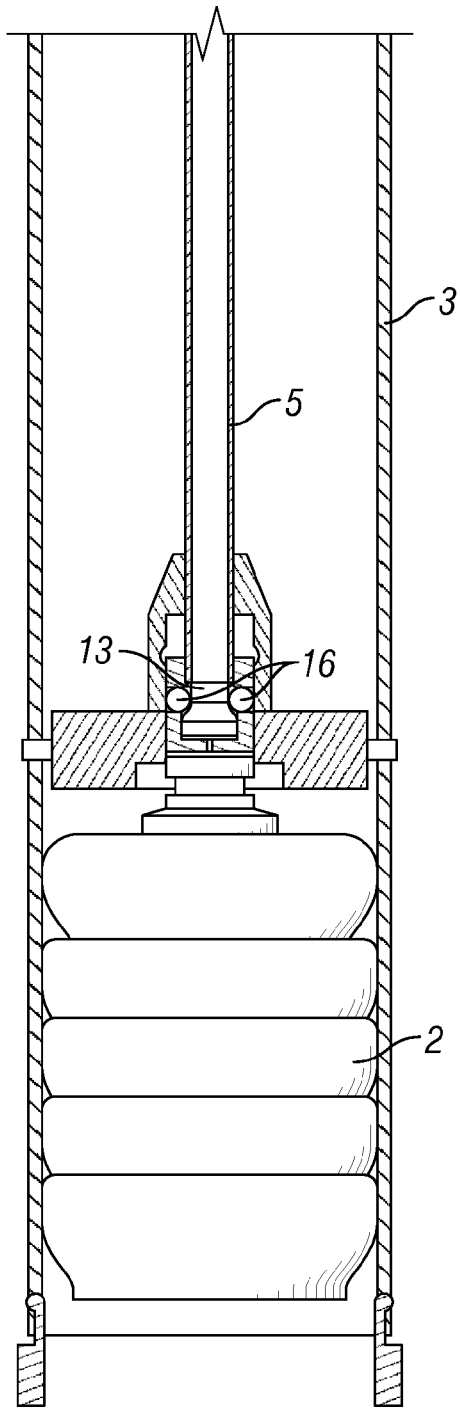
FIG. 5 is a detailed view of the lower portion of the apparatus of an embodiment, just prior to the launch of the top cementing plug.

The first portion of the apparatus described in the first aspect is installed inside a casing string 20. A first process fluid is pumped from the surface through tubular body 19. A bottom dart 11 is launched into the process fluid stream in the tubular body 19. A second process fluid is pumped behind the bottom dart 11. After a desired volume of second process fluid has been pumped into the well, a top dart 9 is launched into the process fluid stream in the tubular body 19, followed by a third process fluid. Step A depicts the moment during which the bottom dart 11 lands on main rod 5. The sleeve 14 prevents movement of the internal rod 13 inside the main rod 5. Fluid flow through ports 6 and 7 is blocked by the bottom dart 11, and the internal movable rod 12 remains in its initial position. As shown in Step B, further fluid pumping forces the bottom dart 11 and main rod 5 downward until the piston 4 has reached a mechanical stop 10, fluid flow through ports 6 and 7 in the tubular body 19 is unobstructed, and movable sleeve 14 has landed on movable sleeve 17, held in place by shear pin 18. As a result, the bottom plug 1 is released from the plug basket 3 and into the casing 20, whereupon it travels through the casing 20 and lands on float equipment at the bottom of the casing string. The bottom plug 1 acts as a barrier between the first and second process fluids, preventing their commingling while traveling through the interior of the casing 20. In Step C, a top dart 9 has landed on the bottom dart 11, obstructing fluid flow through ports 6 and 7. Further pumping causes the top dart 9 to force the internal rod 12 to move and protrude from the posterior of bottom dart 11 and into the sleeve 14 attached to the top of the main rod 5. In Step D, the movement of the internal rod 12 results in two events. First, downward force upon movable sleeve 17 causes the shear pin 18 to break, thereafter allowing movable sleeve 17 to travel downward (FIG. 4). Second, internal rod 12 forces the other internal rod 13 to move downward inside the main rod 5. This motion forces the internal rod 13 into the sleeve 15, thereby forcing the ball bearings 16 to move inward (FIG. 5). The inward movement of the ball bearings 16 frees the main rod 5 and, as shown in Step E, further fluid pumping allows the top dart 9 to move past ports 6 and 7, whereupon the main rod 5 moves past the piston 4 and forces the top plug 2 out of the plug basket 3 and into the casing 20. The top plug 2 travels through the casing 20 and lands on the bottom plug 1 at the bottom of the casing string. The top plug 2 acts as a barrier between the second and third process fluids, preventing their commingling while traveling through the interior of the casing 20. When the top plug 2 lands on the bottom plug 1, the region in the wellbore surrounding the casing 20 is filled with second process fluid, the interior of the casing is filled with third process fluid, and the interior of the casing is isolated from the annulus.

It will be understood by those skilled the art that the internal volume of the casing 20 may be less than the amount of second process fluid necessary to fill the annular region surrounding the casing 20. In such cases, the second portion of the first aspect of the invention, the bottom dart 11 with movable rod 12, will reach the first portion of the first aspect of the invention before the desired quantity of process fluid has been pumped into the tubular body 19. Thus, the bottom plug 1 may be launched before the top dart 9 is launched.

A third aspect is a method for cementing a subterranean well.

The first portion of the apparatus described by the first aspect is installed inside a casing string 20. Drilling fluid is pumped from the surface through a tubular body 19. A bottom dart 11 is launched into the drilling-fluid stream in the tubular body 19. A cement slurry is pumped behind the bottom dart 11. The cement slurry may be preceded by a spacer fluid, a chemical wash, or both. After a desired volume of cement slurry has been pumped into the well, a top dart 9 is launched into the cement-slurry stream in the tubular body 19, followed by a displacement fluid which may include (but not be limited to) drilling fluid and a completion fluid. FIG. 3, Step A depicts the moment during which the bottom dart 11 lands on main rod 5. The sleeve 14 prevents movement of the internal rod 13 inside the main rod 5. Fluid flow through ports 6 and 7 is blocked by the bottom dart 11, and the internal movable rod 12 remains in its initial position. As shown in Step B, further fluid pumping forces the bottom dart 11 and main rod 5 downward until the piston 4 has reached a mechanical stop 10, fluid flow through ports 6 and 7 in the tubular body 19 is unobstructed and movable sleeve 14 has landed on and movable sleeve 17, held in place by shear pin 18. As a result, the bottom plug 1 is released from the plug basket 3 and into the casing 20, whereupon it travels through the casing 20 and lands on float equipment at the bottom of the casing string. The bottom plug 1 acts as a barrier between the drilling fluid and the cement slurry, preventing their commingling while traveling through the interior of the casing 20. In Step C, the top dart 9 has landed on the bottom dart 11, obstructing fluid flow through ports 6 and 7. Further pumping causes the top dart 9 to force the internal rod 12 to move and protrude from the bottom of bottom dart 11 and into the sleeve 14 attached to the top of the main rod 5. In Step D, the movement of the internal rod 12 results in two events. First, downward force upon movable sleeve 17 causes the shear pin 18 to break, thereafter allowing movable sleeve 17 to travel downward (FIG. 4). Second, internal rod 12 forces the other internal rod 13 to move downward inside the main rod 5. This motion forces the internal rod 13 into the sleeve 15, thereby forcing the ball bearings 16 to move inward (FIG. 5). The inward movement of the ball bearings 16 frees the main rod 5 and, as shown in Step E, further fluid pumping allows the top dart 9 to move past ports 6 and 7, whereupon the main rod 5 moves past the piston 4 and forces the top plug 2 out of the plug basket 3 and into the casing 20. The top plug 2 travels through the casing 20 and lands on the bottom plug 1 at the bottom of the casing string. The top plug 2 acts as a barrier between the cement slurry and the displacement fluid, preventing their commingling while traveling through the interior of the casing 20. When the top plug 2 lands on the bottom plug 1, the region in the wellbore surrounding the casing 20 is filled with cement slurry, the interior of the casing is filled with displacement fluid, and the interior of the casing is isolated from the annulus.

It will be understood by those skilled the art that the internal volume of the casing 20 may be less than the amount of cement slurry necessary to fill the annular region surrounding the casing 20. In such cases, the second portion of the first aspect of the invention, the bottom dart 11 with movable rod 12, will reach the first portion of the first aspect of the invention before the desired quantity of process fluid has been pumped into the tubular body 19. Thus, the bottom plug 1 may be launched before the top dart 9 is launched.

All aspects may be applied in oil and gas wells, geothermal wells, water wells, and wells for chemical waste disposal, enhanced recovery of hydrocarbons and carbon sequestration.

The preceding description has been presented with reference to some embodiments of the broader invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A system for launching cementing plugs in a subterranean well, wherein a bottom plug and a top plug are launched from a plug basket by means, comprising:

i. a first portion, comprising
   a. the plug basket that initially contains the bottom plug and the top plug;
   b. a piston above the plug basket, initially connected to a main rod;
   c. a first movable rod inside the main rod;
   d. a first sleeve around the main rod within which a release mechanism is initially installed in a manner such that the main rod is securely attached to the piston;
   e. a second movable sleeve inside a tubular body that is positioned above the first sleeve under which a shear pin fixed to the tubular body prevents downward movement of the second movable sleeve;
   f. a third movable sleeve mounted at the top of the main rod, into which a first moveable rod protrudes;
   g. ports in the tubular body through which wellbore-service fluids may flow; and ii. a second portion, comprising a bottom dart having a second movable rod that initially extends from the top, but can be pushed down so that it extends from the bottom; and iii. a third portion, comprising a top dart.

2. The system of claim 1, wherein the release mechanism comprises shear pins, latches or ball bearings.

3. The system of claim 1, wherein the subterranean well is an oil well, a gas well, a geothermal well, a water well, a well for chemical-waste disposal, a well for enhanced recovery of hydrocarbons or a well for carbon sequestration.

4. A method for launching cementing plugs in a subterranean well, wherein a bottom plug and a top plug are launched by means, comprising:

i. installing a system inside a casing string, the system comprising:
   a. a plug basket that initially contains the bottom plug and the top plug;
   b. a piston above the plug basket, initially connected to a main rod;
   c. a first movable rod inside the main rod;
   d. a first sleeve around the main rod within which a release mechanism is initially attached in a manner such that the main rod is securely attached to the piston;
   e. a second movable sleeve inside a tubular body that is positioned above the first sleeve under which a shear pin fixed to the tubular body prevents downward movement of the first movable sleeve;
   f. a third movable sleeve mounted at the top of the main rod into which the first movable rod protrudes; and
   g. ports in the tubular body through which wellbore-service fluids may flow;

ii. pumping process fluid through the tubular body inside the casing string, and allowing the fluid to flow through the ports;

iii. launching a bottom dart into the process-fluid stream inside the tubular body;

iv. pumping a desired volume of process fluid behind the bottom dart;

v. launching a top dart into the process-fluid stream inside the tubular body;

vi. pumping process fluid behind the top dart;

vii. continuing to pump until the bottom dart lands on the main rod, blocking fluid flow through the ports;

viii. continuing to pump process fluid until the bottom dart clears the ports, causing the third moveable sleeve to move downward until it seats on the second moveable sleeve that is secured by the shear pin, and causing the main rod to push the piston downward, thereby forcing the bottom plug to exit the plug basket; and ix. continuing to pump process fluid until the top dart clears the ports, pushing the second movable rod inside the bottom dart so that it protrudes from the other end, causing the first movable rod inside the main rod to move downward, thereby applying sufficient force upon the second movable sleeve to break the shear pin, thereby allowing the second movable sleeve to travel downward, thereby actuating a release mechanism within the first sleeve, thereby allowing the main rod to pass through the piston thereby forcing the top plug to exit the plug basket.

5. The system of claim 4, wherein the release mechanism comprises shear pins, latches or ball bearings.

6. The method of claim 5, wherein the interior volume of the casing string is less than the volume of second process fluid necessary to fill the annular region surrounding the casing string, resulting in the launch of the bottom plug before the launch of the top dart.

7. The method of claim 4, wherein the interior volume of the casing string is less than the volume of second process fluid necessary to fill the annular region surrounding the casing string, resulting in the launch of the bottom plug before the launch of the top dart.

8. The method of claim 4, wherein the subterranean well is an oil well, a gas well, a geothermal well, a water well, a well for chemical-waste disposal, a well for enhanced recovery of hydrocarbons or a well for carbon sequestration.

9. A method for cementing a subterranean well, wherein a bottom cementing plug and a top cementing plug are launched by independent means, comprising:

i. pumping drilling fluid through a tubular body, and allowing the fluid to flow through ports;

ii. launching a bottom dart into the drilling-fluid stream inside the tubular body;

iii. pumping a desired volume of fluid comprising a cement slurry behind the bottom dart;

iv. launching a top dart into the fluid comprising a cement slurry that flows inside the tubular body;

v. pumping a displacement fluid behind the top dart;

vi. continuing to pump until the bottom dart lands on a main rod, blocking fluid flow through the ports;

vii. continuing to pump until the bottom dart clears the ports, causing a third movable sleeve to move downward until it seats on a second movable sleeve that is secured by a shear pin, and causing the main rod to push a piston downward, thereby forcing the bottom plug to exit a plug basket;

viii. continuing to pump until the top dart lands on the bottom dart, blocking fluid through the ports;

ix. continuing to pump until the bottom dart clears the ports, pushing a second movable rod inside the bottom dart so that it protrudes from the other end, causing a first movable rod inside the main rod to move downward, thereby applying sufficient force upon the second movable sleeve to break the shear pin, thereby allowing the second movable sleeve to break the shear pin, thereby allowing the second movable sleeve to travel downward, thereby actuating a release mechanism within a first sleeve, thereby allowing the main rod to pass through the piston, thereby forcing the top plug to exit the plug basket;

x. continuing to pump until the top plug lands on float equipment at the bottom of the casing string.

10. The method of claim 9, wherein the release mechanism comprises shear pins, latches or ball bearings.

11. The method of claim 10, wherein the interior volume of the casing string is less than the volume of cement slurry necessary to fill the annular region surrounding the casing string, resulting in the launch of the bottom plug before the launch of the top dart.

12. The method of claim 11, wherein the cement slurry is preceded by a spacer fluid, a chemical wash or both.

13. The method of claim 9, wherein the interior volume of the casing string is less than the volume of cement slurry necessary to fill the annular region surrounding the casing string, resulting in the launch of the bottom plug before the launch of the top dart.

14. The method of claim 13 wherein the cement slurry is preceded by a spacer fluid, a chemical wash or both.

15. The method of claim 9, wherein the cement slurry is preceded by a spacer fluid, a chemical wash or both.

16. The method of claim 15, wherein the cement slurry is first preceded by a chemical wash and then by a spacer fluid.

17. The method of claim 9, wherein the subterranean well is an oil well, a gas well, a geothermal well, a water well, a well for chemical-waste disposal, a well for enhanced recovery of hydrocarbons or a well for carbon sequestration.

* * * * *